US005983824A

United States Patent [19]

Hernandez

[11] Patent Number: 5,983,824

[45] Date of Patent: Nov. 16, 1999

[54] FRAME AND SLIDING RETRACTABLE TOP ASSEMBLY FOR BOATS

[76] Inventor: Ulises Hernandez, 4531 N.W. 2nd St., Miami, Fla. 33126

[21] Appl. No.: 09/292,276

[22] Filed: Apr. 15, 1999

Related U.S. Application Data

[63] Continuation of application No. 08/921,905, Sep. 2, 1997, abandoned.

[51] Int. Cl.[6] ..... B63B 17/00

[52] U.S. Cl. ..... 114/361

[58] Field of Search ..... 114/343, 361; 135/88.01, 88.03, 121, 156, 119, 87, 96

[56] References Cited

U.S. PATENT DOCUMENTS 2,493,833 1/1950 Reynolds ..... 114/361

2,947,277 8/1960 Stevens ..... 114/361

*Primary Examiner*—Ed Swinehart

*Attorney, Agent, or Firm*—Michael C. Cesarano

[57] ABSTRACT

The present invention overcomes the drawbacks associated with earlier top designs by providing a rigid frame at a sufficient height above the boat to permit persons to move about comfortably beneath it. A flexible cover is suspended from the frame and is held taut by the frame. The flexible cover is attached to the frame with sliding connectors. The cover may be moved between an open position and a closed position by sliding one end along the frame. In the "open" position, the cover is folded back in accordion folds against one end of the frame. When slid "closed," the cover occupies nearly the entire surface within the perimeter of the frame. As the flexible cover is suspended between opposing frame members, it will remain taut and free from flapping even when the boat is traveling at high speed.

8 Claims, 3 Drawing Sheets

FRAME AND SLIDING RETRACTABLE TOP ASSEMBLY FOR BOATS

This is a continuation application of Ser. No. 08/921,905 filed on Sep. 2, 1997 now abandoned.

The present invention relates to a frame and sliding retractable top assembly for boats, and more specifically concerns a top having a flexible cover suspended from a rigid frame in which the cover may be opened by sliding the movable end of the cover to one end of the frame to form accordion folds, and may be closed by sliding the movable end of the cover to the other end of the frame.

Although many designs are employed for boat tops, relatively few of them are capable of providing protection from the sun and rain for persons in small, open boats. Of those tops that do provide such protection, many are configured to attach to a boat windshield for support and those generally do not provide sufficient headroom to permit persons of ordinary stature to stand while the top is in place. Other configurations include the "camper" or "Bimini" style tops which generally have a frame consisting of at least two separate frame members, each of which is attached by hinges to opposite sides of the gunwales of a boat, a fabric top configured to fit around frame members, and fore and aft adjustable, retaining webbed belts or ropes spread the frame longitudinally and pull the fabric taut against the frame. Although such tops are convertible, the hinged frame cannot be moved until either the fore or aft retaining belts are disconnected and the frame and fabric are swung either forward or aft as a unit to lie flat along the gunwales. In that position, the frame cross-members and fabric create a barrier across the beam that makes it difficult to move about the boat when the top is in the "down" position. In addition, if the boat is driven at high speed with the top in the down position, the fabric will catch the wind and will either flap violently, rattle and shake the frame, or may even rip away from the frame.

SUMMARY OF THE INVENTION

The present invention overcomes the drawbacks associated with earlier top designs by providing a rigid frame at a sufficient height above the boat to permit persons to move about comfortably beneath it. A flexible cover is suspended from the frame and is held taut by the frame. The flexible cover is attached to the frame with sliding connectors. The cover may be moved between an open position and a closed position by sliding one end along the frame. In the "open" position, the cover is folded back in accordion folds against one end of the frame. When slid "closed," the cover occupies nearly the entire surface within the perimeter of the frame. As the flexible cover is suspended between opposing frame members, it will remain taut and free from flapping even when the boat is traveling at high speed.

BRIEF DESCRIPTION OF THE DRAWINGS

Further objects and advantages of the present invention can be found in the detailed description of the preferred embodiment when taken in conjunction with the accompanying drawings in which.

DETAILED DESCRIPTION OF THE PREFERRED EMBODIMENTS

Figure 1:
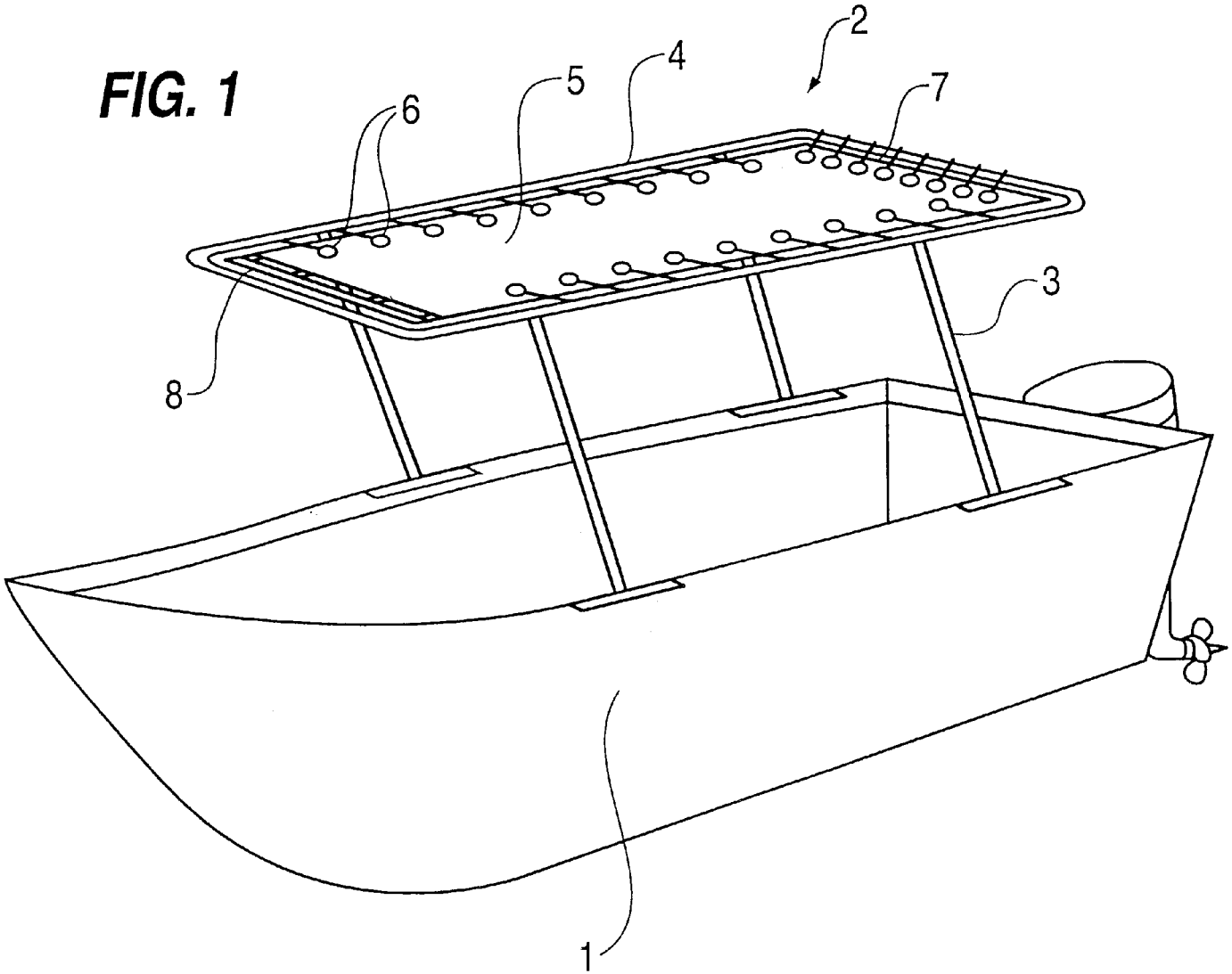
FIG. 1 is a side view depicting the top attached to a small boat.

As depicted in FIG. 1, a small boat 1 is covered by a top 2 that is suspended above the boat by frame support members 3. The top includes a substantially horizontal generally rectangular frame 4, a cover made of canvas or some other flexible fabric 5, slidable connectors 6 that hold the cover between two opposing frame members and that may be adjusted to keep the flexible fabric taut. The aft end of the cover is connected to the frame by a line, rope 7 or other suitable connection material, while the forward end of the cover is sewn into a pocket to receive a sliding cover suspension bar 8. Frame support members 3 are of sufficient length to suspend the frame 4 at a height above the boat sufficient to permit persons to stand beneath the frame. Although depicted generally as being positioned upon the gunwales of the boat, frame support members 3 could alternatively be positioned at or near the center of the boat, being affixed to the deck or center console, and leaving the areas above the gunwales open and unobstructed.

Figure 2:
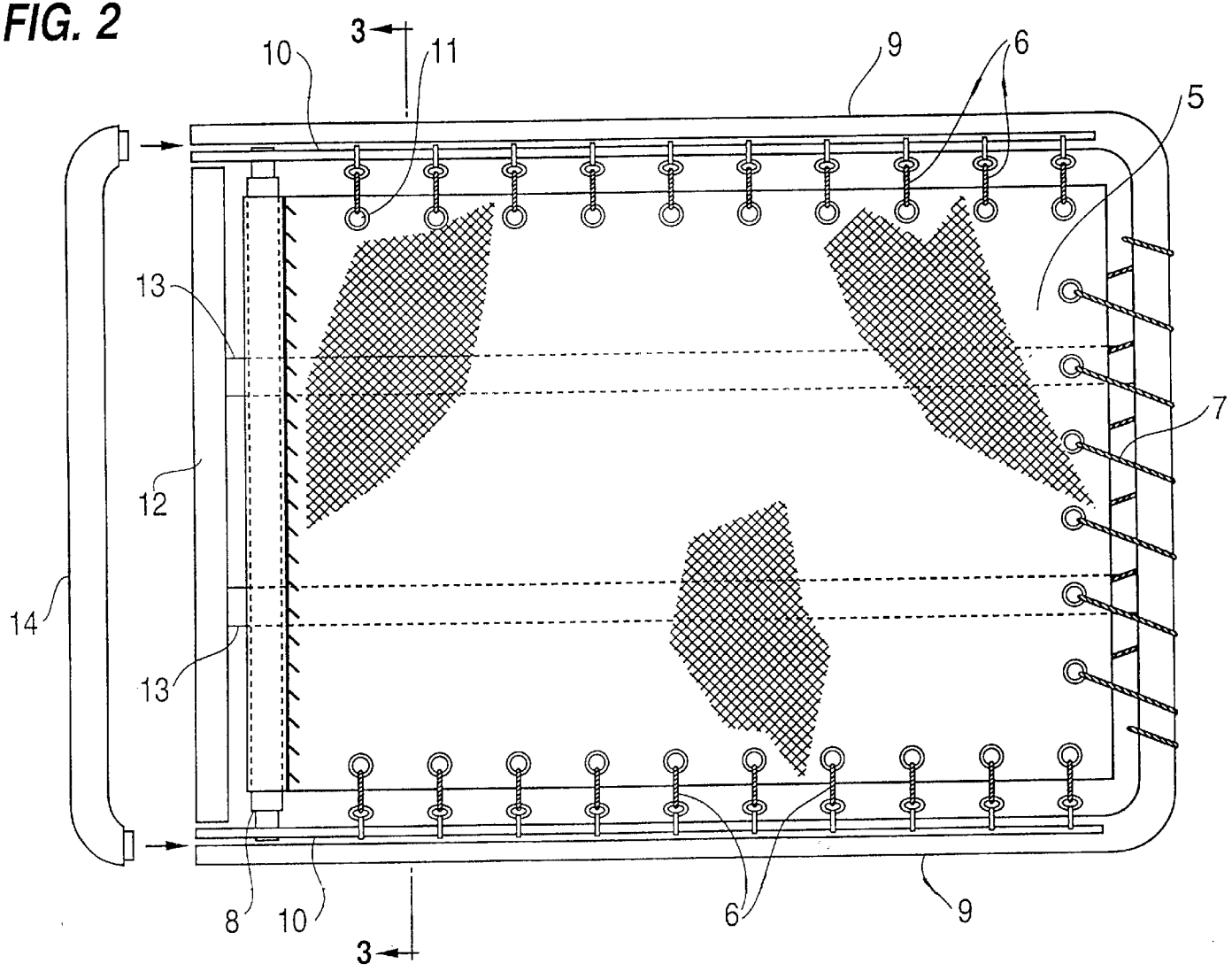
FIG. 2 is a top view of the frame and flexible cover.

FIG. 2 shows details of the frame in which opposing frame members 9 each have a groove 10 to receive the sliding end of connectors 6. The sliding ends of connectors 6 may be made of nylon or some other friction-minimizing material, and may be of any configuration that will permit them to slide while holding flexible cover 5 taut. The non-sliding end of connectors 6 may be tied or otherwise affixed to the flexible cover through grommets 11. As shown in FIG. 2, frame reinforcement bar 12 is attached at either end to opposing frame members 9, and is also attached to longitudinal support members 13, which provide structural rigidity to the frame. Frame end piece 14 is removable, to enable the removal and replacement or repair of the flexible cover 5 or slidable connectors 6. The ends of sliding cover suspension bar 8 also fit within grooves 10. As so configured, sliding cover suspension bar 8 may be positioned at either extreme end of grooves 10 or at any intermediate location, thereby holding flexible cover 5 in any desired position between fully open and fully closed. If desired, the ends of sliding cover suspension bar 8 may be configured to receive a locking mechanism sufficient to hold the bar in place in any chosen location. A rope or line 7 is used to attach the non-movable end of cover 5 to the end of frame 4 opposite frame end piece 14.

Figure 3:
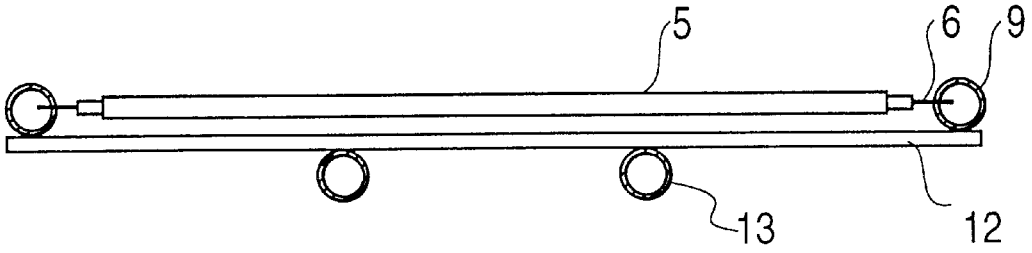
FIG. 3 is a cross-sectional rear view of the top taken along lines A–A'

FIG. 3 shows the positioning of grooves 10 in opposing frame members 9 with respect to flexible cover 5, sliding cover suspension bar 8, frame reinforcement members 13 and reinforcement bar 12.

When maximum cover from rain or sun is desired, flexible cover 5 may be slid to the fully closed position in which sliding cover suspension bar 8 is at its closest point to frame end piece 14. When locked in that position, flexible cover 5 will be under tension both longitudinally and laterally, and will resist flapping even at high speeds. Locking mechanisms suitable for holding sliding cover suspension bar 8 in any desired position are well-known in the art, and any suitable mechanism can be employed to hold the bar in position.

Longitudinal support members 13 provide strength to the frame and help to resist twisting or bending due to vertical forces that may act upon the top while the boat is traveling at high speed. Longitudinal support members 13 may also be used as hard points for attachment of the top assembly to the boat where a centered support system is desired instead of one that is laterally positioned to utilize frame support members 3 which are shown in FIG. 1.

The top assembly may be positioned with the sliding cover suspension bar 8 toward the forward part of the boat or toward the after part of the boat. This choice is primarily a matter of convenience, and may be dictated by differing boat configurations with which this top is used.

Slidable connectors 6 may be fashioned from materials such as nylon, stainless steel or chrome-plated metal, rope, or other suitable materials, and may use elastic or mechanical springs to hold the flexible cover taut over time and varying conditions of temperature and humidity. When installing or replacing the flexible cover 5, slidable connectors can be inserted into grooves 10 upon the removal of frame end piece 14. Removal of flexible cover 5 for replacement or repair is easy, requiring only that the fixed end of flexible cover 5 be released from its attachment to frame 4 at the end opposite frame end piece 14, and that frame end piece 14 be removed from frame 4. Slidable connectors 6 will then freely slide to the ends of grooves 9 and may be removed from the assembly.

It will be understood that other various modifications within the spirit of this invention may occur to those skilled in the art. For example, longitudinal support members 13 may be configured in an "X" shape, rather than in parallel, or grooves 10 for receiving the sliding end of slidable connectors 6 may be replaced by tracks that serve the same purpose. It is intended that no limitations be placed on the invention except as defined by the scope of the appended claims.

The claims appended hereto are meant to cover modifications and changes within the spirit and scope of the present invention.

What is claimed is:

1. A frame and slidable top assembly for a boat comprising:

a frame adapted to be attached to a boat;

a flexible top;

said frame including a substantially rigid portion forming an upper frame located above said boat at a height sufficient to permit persons to stand in said boat underneath said upper frame, being suspended above said boat by a plurality of frame support members such that a substantially unobstructed open space is formed between said upper frame and the sides of said boat, said upper frame having at least two upper frame members extending longitudinally alongside said flexible top on opposite sides of said flexible top and suspending said flexible top therebetween;

at least two of said upper frame members having a channel to receive a plurality of slidable connectors;

one end of each of said slidable connectors being received within one of said channels and being slidable therealong;

another end of each of said slidable connectors being attached to attachment points located at spaced intervals near the edge of said flexible top;

said flexible top being slidably suspended above said boat and adjustable to any position between maximum coverage in which said slidable connectors are spaced apart at maximum intervals along said upper frame members, and minimum coverage in which said slidable connectors are spaced at minimum intervals along said upper frame portion.

2. The apparatus claimed in claim 1 in which said flexible top has four sides and two of said upper frame members having a channel extend around two opposite sides of said flexible top and a third upper frame member extends around at least one third side of said flexible top to form a U-shape around three sides of said flexible top;

said flexible top being slidably attached on said two opposite sides to said two upper frame members having a channel by said slidable connectors and being non-slidably attached to said third upper frame member at said third side.

3. The apparatus claimed in claim 2 in which the fourth side of said flexible top is connected to a substantially rigid bar, said bar being slidably connected at its ends to said two upper frame members having a channel whereby said bar may be positioned at any location along said two upper frame members between a fully closed position in which said flexible top is disposed to cover a maximum area and a fully open position in which said flexible top is disposed to cover a minimum area.

4. The apparatus claimed in claim 3 wherein said bar is slidably connected to said two upper frame members having a channel with connectors that may be locked to hold said bar at a desired location along said upper frame members.

5. The apparatus claimed in claim 2 in which said channel in said upper frame members comprises a slot.

6. A frame and slidable top assembly for a boat comprising:

a frame adapted to be attached to a boat;

a flexible top;

said frame including an upper frame located above said boat, said upper frame being suspended above said boat by a plurality of frame support members such that a substantially unobstructed open space is formed between said upper frame and the sides of said boat, said upper frame having two generally horizontal upper frame members extending longitudinally;

said flexible top being suspended between said upper frame members and slidably attached to said upper frame members whereby said flexible top may be positioned to cover a maximum area when said flexible top is fully stretched along said upper frame members, and said flexible top may be positioned to cover a minimum area when said flexible top is fully folded and bunched.

7. A frame and slidable top assembly for a boat comprising:

a frame adapted to be attached to a boat;

a flexible top having four sides;

said frame including a substantially rigid portion forming an upper frame located above said boat at a height sufficient to permit persons to stand in said boat underneath said upper frame, said upper frame having at least two upper frame members extending longitudinally alongside said flexible top on opposite sides of said flexible top and suspending said flexible top therebetween;

two of said upper frame members on opposite sides of said flexible top having a channel to receive a plurality of slidable connectors;

a third upper frame member extending around at least one third side of said flexible top to form a U-shape around three sides of said flexible top;

one end of each of said slidable connectors being received within one of said channels and being slidable therealong;

another end of each of said slidable connectors being attached to attachment points located at spaced intervals near the edge of said flexible top;

the fourth side of said flexible top being connected to a substantially rigid bar, said bar being slidably connected at its ends to said two upper frame members having a channel whereby said bar may be positioned at any location along said two upper frame members between a fully closed position in which said flexible top is disposed to cover a maximum area and a fully-open position in which said flexible top is disposed to cover a minimum area.

8. The apparatus claimed in claim 7 wherein said bar is slidably connected to said two upper frame members having a channel with slidable connectors that may be locked to hold said bar at a desired location along said upper frame members.

* * * * *